US007730710B2

(12) United States Patent
Rejzner

(10) Patent No.: US 7,730,710 B2
(45) Date of Patent: Jun. 8, 2010

(54) STRAP WITH ARTICULATED LINKS

(75) Inventor: James Rejzner, Collonges-Sous-Saleve (FR)

(73) Assignee: Rolex S.A., Geneva (CH)

( * ) Notice: Subject to any disclaimer, the term of this patent is extended or adjusted under 35 U.S.C. 154(b) by 0 days.

(21) Appl. No.: 12/263,803

(22) Filed: Nov. 3, 2008

(65) Prior Publication Data

US 2009/0113870 A1 May 7, 2009

(30) Foreign Application Priority Data

Nov. 6, 2007 (EP) ..... 07405321

(51) Int. Cl.
*F16G 13/00* (2006.01)

(52) U.S. Cl. ..... 59/80; 59/78; 59/84; 63/4

(58) Field of Classification Search ..... 59/78, 59/80, 84; 63/4, 5

See application file for complete search history.

(56) References Cited

U.S. PATENT DOCUMENTS

| | | | | |
|---|---|---|---|---|
| 4,638,627 | A | 1/1987 | Wullsehleger et al. | |
| 6,026,637 | A * | 2/2000 | Dombre et al. | 59/80 |
| 6,318,064 | B2 * | 11/2001 | Vandini | 59/80 |
| 6,488,404 | B2 * | 12/2002 | Zurcher et al. | 368/282 |
| 6,494,030 | B2 * | 12/2002 | Cazard | 59/80 |
| 6,622,469 | B2 * | 9/2003 | Gunster et al. | 59/80 |
| 6,655,832 | B2 * | 12/2003 | Bach et al. | 59/78 |
| 7,043,895 | B2 * | 5/2006 | Mace | 59/80 |
| 7,146,793 | B1 * | 12/2006 | Hyun | 59/80 |
| 7,303,330 | B2 * | 12/2007 | Hartzband | 24/265 WS |

FOREIGN PATENT DOCUMENTS

| | | | |
|---|---|---|---|
| CH | 659 571 | A5 | 2/1987 |
| CH | 695 037 | A5 | 11/2005 |
| CN | 1 948 774 | A | 4/2007 |
| EP | 0 243 315 | A1 | 10/1987 |
| FR | 2 565 470 | A1 | 12/1985 |
| FR | 2 723 823 | A1 | 3/1996 |
| JP | 2003-38218 | A | 2/2003 |

OTHER PUBLICATIONS

European Search Report No. EP 07 40 5321, date of mailing Apr. 21, 2008.

* cited by examiner

*Primary Examiner*—David B Jones
(74) *Attorney, Agent, or Firm*—Westerman, Hattori, Daniels & Adrian, LLP

(57) ABSTRACT

Said strap with articulated links, in particular for a watch, comprises at least three adjacent rows of links offset from one adjacent row to another, in which at least one friction surface (3, 13, 23-163) of each joint is made of a material of which the hardness is >800 HV. Said bearing surface (3, 13, 23-163) is in contact with at least one joint element (5, 15, 25-165) having at least one friction surface made of a second material selected from the following materials: ceramic, ceramic-metal composite, amorphous carbon, stainless steel without nickel, cobalt alloy, gold or gold alloy, platinum or platinum alloy, platinoid or platinoid alloy, titanium or titanium alloy, capable of reducing the frictional wear with the friction surface (3, 13, 23-163).

18 Claims, 7 Drawing Sheets

STRAP WITH ARTICULATED LINKS

The present invention relates to a strap with articulated links, in particular for a watch, comprising at least three adjacent longitudinal rows of links offset longitudinally from one adjacent row to another, in which at least one friction surface of each joint is made from a first material of which the hardness is >800 HV.

The problem with the wear of the joints of straps with links, in particular watch straps, has been a recurrent problem since the appearance of this type of strap. The wear increases the clearance in the region of the joints, providing an unattractive appearance to the strap. This wear not only affects the hinge pins but also the links of the strap when they are metal links, and in particular in the case of straps comprising a plurality of adjacent rows of links, the clearance of the joints making it possible ultimately for grooves to be formed in their adjacent lateral faces, thus damaging the appearance of the strap.

It has already been proposed to remedy this drawback in EP 0 243 315 by interposing jewel bearings between the links and the hinge pins.

In contrast to what this document sets forth, producing joint elements of high durability, in this case jewel bearings, does not on its own make it possible to resolve the problem of the wear of the joints. This wear may be significant, even more so, depending on the case. Moreover, the choice of a ruby in the form of a crystal poses problems of reliability, given its relative fragility. More specifically, the joint elements of a strap are liable to be subjected to severe stresses which may lead to the rupture of the joint elements made of jewel bearings, thus able to cause damage which is difficult to repair.

Irrespective of this risk, it is necessary to know that a strap is exposed to abrasive dust, in addition to corrosive substances (salt water and sweat, in particular). Depending on the material of the counter surface of the bearing which rubs against the jewel bearing element, this dust and these corrosive substances may cause wear of this counter surface which is at least as significant as the absence of the jewel bearing element, as tests for wear carried out over a long period on devices simulating different conditions have shown.

The object of the present invention is to reduce the wear of the friction surfaces of the joints of straps with metal links.

To this end, the subject of the invention is a strap with articulated metal links, in particular for a watch, comprising at least three adjacent longitudinal rows of links (MB, MC) offset longitudinally from one adjacent row to another and connected and positioned by transverse passages which receive connecting rods, a strap in which each joint comprises, on the one hand, friction surfaces with axial guidance and, on the other hand, friction surfaces with lateral guidance, of which some friction surfaces are made of a first material of which the hardness is >800 HV, characterized in that all the friction surfaces of each joint consist of a pair of materials formed from said first material and a second material selected from the following materials: ceramic, ceramic-metal composite, amorphous carbon, stainless steel without nickel, cobalt alloy, gold, gold alloy, platinum, platinum alloy, platinoid, platinoid alloys, titanium, titanium alloy, each of the pairs of materials making it possible to reduce substantially the wear between said friction surfaces relative to any other pair of materials.

Advantageously, the joint surface is that of an element made of ceramic which is sintered or deposited on a substrate, or a ceramic-metal composite which is sintered or deposited on a substrate in the form of alternate metal and ceramic layers.

Alternatively, one joint surface is that of a substrate covered with amorphous carbon.

Tests simulating wear over a long period in corrosive and abrasive conditions have shown a marked reduction in wear between the joint surfaces according to the invention and the prior art.

The accompanying drawings illustrate, schematically and by way of example, different embodiments of the strap with metal articulated links which form the subject of the present invention.

Various embodiments of the present invention are possible. All these embodiments have, however, a common theme, namely only to allow friction between materials identified for their compatibility for rubbing against one another with a minimum of wear, even in the presence of abrasive and corrosive agents, as is the case of a watch strap with articulated links, worn in all circumstances, without the slightest protection of its articulated elements being possible. All the illustrated embodiments only show segments of straps with links, the formation of complete straps being obtained by the addition of links or groups of fixed links, identical to those illustrated, until the desired length of the portion is obtained. The elements for connecting the strap portions to the watch case, in addition to the closure, which is used to connect the two portions to one another and which, in the case of this type of strap is generally a closure known as an "unfolding clasp", do not form part of the invention. Moreover, they have not been illustrated. This obviously does not prevent the joint surfaces between the strap links and the adjacent elements of the closure being able to use the pairs of materials according to the present invention, said invention relating to all the joints of the different elements of a strap with links, including therefore its joint with the closure and possibly the watch case.

Figure 1:
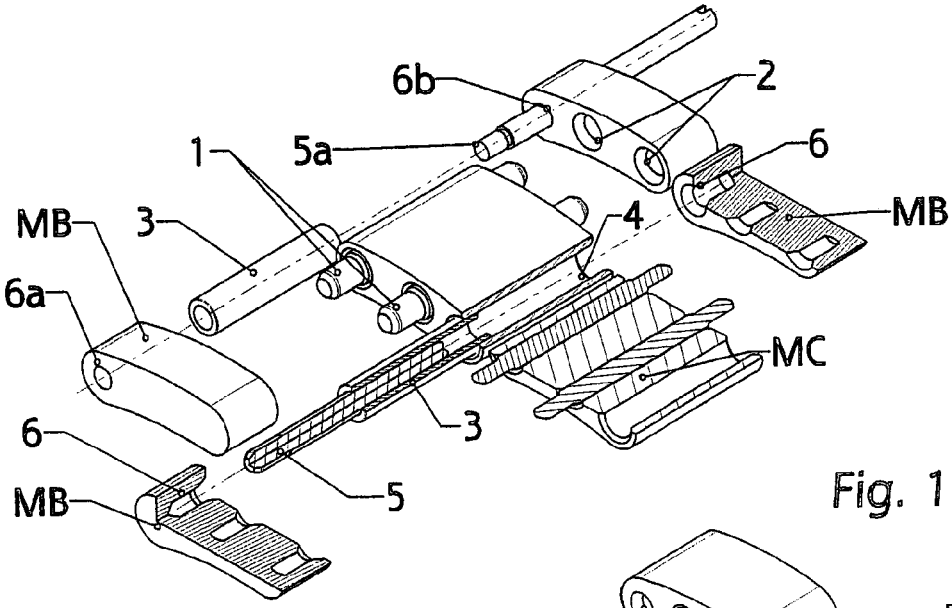
FIG. 1 is an exploded view in perspective with parts of a first embodiment in section.

In the embodiment illustrated by FIG. 1, two central links MC and four edge links MB are shown forming two groups of fixed links articulated to one another. In this example, these links are made of a material which is not capable of reducing the wear when it rubs against a surface of which the hardness is >800 HV, such as a surface made of ceramic or a ceramic-metal composite.

The central links MC are offset in the longitudinal direction of the strap relative to the two rows of edge links MB, such that a central link MC overlaps relative to two edge links MB of each row. A central link MC comprises three transverse passages of which two each receive a connecting element 1 formed by a rod of which the two end parts of smaller diameters protrude beyond the central link MC on each side. The projecting parts of the connecting elements 1 are intended to be driven into blind holes 2 of two edge links MB which oppose one another. As a result, a central link MC forms a fixed assembly with the two edge links MB into which the projecting ends of the connecting elements 1 are driven.

The joint is thus created between two adjacent assemblies of fixed links, each comprising a central link MC offset longitudinally relative to two edge links MB aligned transversely to the strap.

The central link MC of this assembly of fixed links comprising a central link MC and two edge links MB is articulated to two edge links of the same assembly of adjacent fixed links. To this end, an attached bearing element, in this example, formed by a tube 3 made of sintered ceramic or a sintered ceramic-metal composite is engaged in the inside of the third transverse passage 4 of the central link MC. The ceramic selected is advantageously zirconia ceramic. A pin 5 is freely engaged in this tube 3 and its ends are driven into two blind holes 6 of two edge links MB of the adjacent assembly of fixed links.

If the strap is made of standard steel for a strap, such as 316L steel, the tube 3 made of sintered ceramic or a sintered ceramic-metal composite, has to be fixed to the central link MC by driving-in or by bonding, for example.

A second hinge pin 5 or 5*a*, as illustrated in FIG. 1, the hinge pin 5*a* is a pin of which one end part is a screw head and the other end part is threaded so as to be screwed into an opening 6*a* of the adjusting edge link MB, whilst the opening 6*b* for the screw head passes through the adjusting edge link MB. These pins 5*a* and the adjusting edge links MB, provided with openings 6*a*, 6*b*, are intended to allow the length of the strap to be adjusted by the removal or the addition of adjusting edge links MB and adjusting pins 5*a*. This is true for all embodiments so that this adjusting system, which is moreover conventional in this type of strap, will not be described further. When adjustment is not permitted, the screw hinge pin 5*a* is replaced by a standard hinge pin 5.

If the hinge pin is a pin 5, it is intended to be fixed in the openings 6 of the two opposing edge links MB, for the articulation of an adjacent assembly of fixed links MC, MB as shown.

The hinge pins 5, 5*a*, are made of one of the materials which makes it possible to reduce frictional wear with the tubes made of sintered ceramic or sintered ceramic-metal composite 3. One of these materials is a cobalt alloy. Amongst the other materials capable of reducing the frictional wear with the tube 3, in conditions to which the watch straps are liable to be subjected during use, may be cited as stainless steels without nickel, gold and gold alloys, platinum and platinum alloys, titanium and titanium alloys, in addition to all the platinoids and their alloys. The choice of material is essentially made depending on the material(s) used to produce the links MB, MC.

Figure 2:
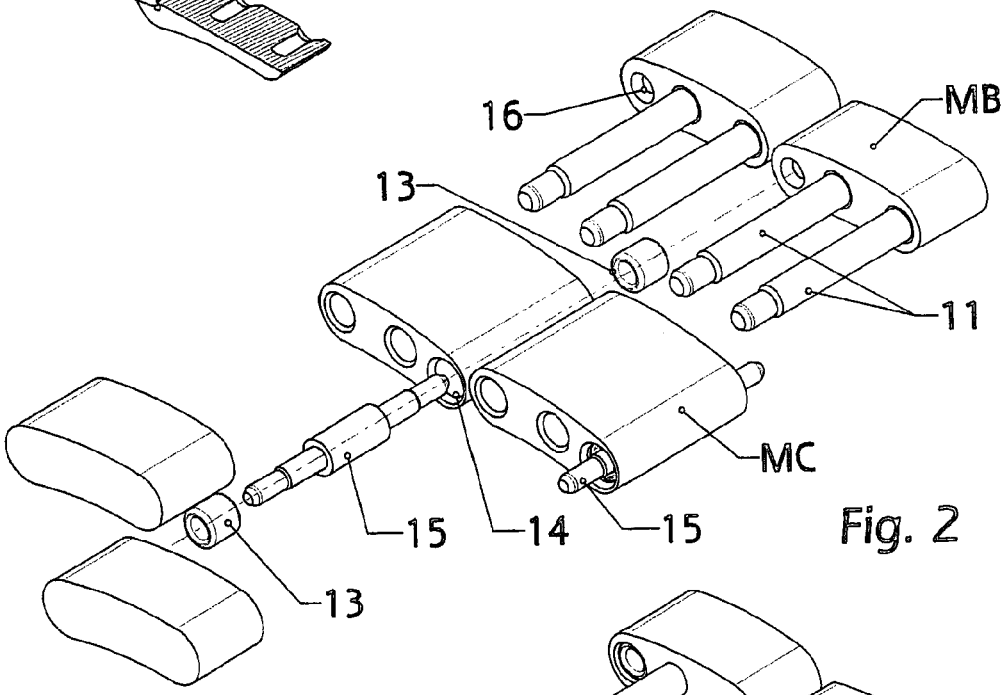
FIG. 2 is an exploded perspective view of a second embodiment.

In the embodiment illustrated by FIG. 2, the tube 3 made of sintered ceramic of the first embodiment is replaced here by two shorter bearing tubes 13 arranged on both sides of the central part of greater diameter of the hinge pin 15. The respective axial positions of these bearing tubes 13 are defined by the bearing surfaces between the central part of the hinge pin 15 and the adjacent parts on which the bearings 13 are mounted. The bearing tubes 13 are driven into or bonded in the opening 14 of the central link MC leaving a very small clearance (several hundredths of a millimeter) between the bearing tubes 13 and the bearing surfaces of the central part of the hinge pin 15.

In turn, the ends of the hinge pin 15 are driven into openings 16 of the edge links MB, thereby creating clearance between the lateral faces of the edge links MB and the lateral faces of the central link MC. This clearance is selected to be very slightly greater than the clearance between the bearing tubes 13 and the bearing surfaces of the central part of the hinge pin 15, such that the lateral faces of the links MB and MC are not able to touch and that lateral friction is only produced between the ceramic bearing tubes 13 and the bearing surfaces of the central part of the hinge pin which is, depending on the nature of the material from which the links MC, MB are formed, made of a cobalt alloy, stainless steel without nickel, gold alloy, platinum alloy or even platinoid alloy or titanium alloy.

The diameter of the central part of the hinge pin 15, is naturally smaller than that of the opening 14 of the central link MC, such that the friction between the cylindrical surfaces is only produced between the internal faces of the bearing tubes and the portions of the pivot pin 15 which pass through the respective bearing tubes 13.

Figure 3:
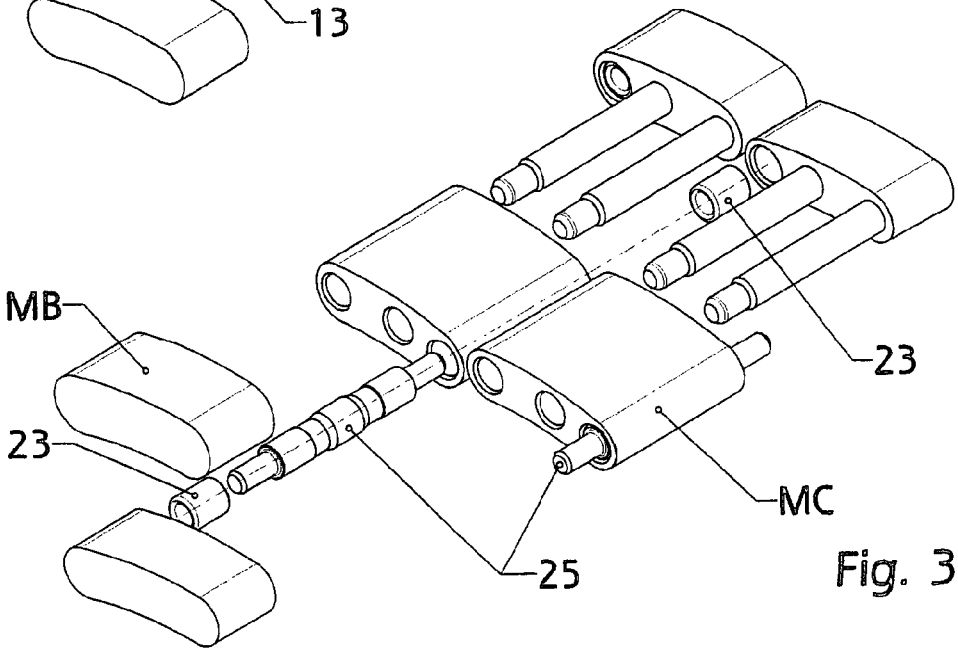
FIG. 3 is an exploded perspective view of a third embodiment.

The object of the embodiment illustrated by FIG. 3 is the same as above. Nevertheless, in this case, the bearing tubes 23 are entirely housed in the edge links MB, either fixed or not depending on the nature of the material of which the links are made. In contrast to the embodiment of FIG. 2, the pivot pins 25 are not fixed in the edge links MB, but in the central link MC. The lateral friction is produced between one end of the bearing tube 23 and a bearing surface of the pivot pin 25 which is in one of the materials capable of reducing the wear with the bearing tube made of sintered ceramic or a sintered ceramic-metal composite. According to a variant, the bearing tube could be made of metal coated with amorphous carbon, also known as DLC (diamond-like carbon), with ceramic or alternate layers of ceramic and metal deposited by PVD (physical vapor deposition).

Figure 4:
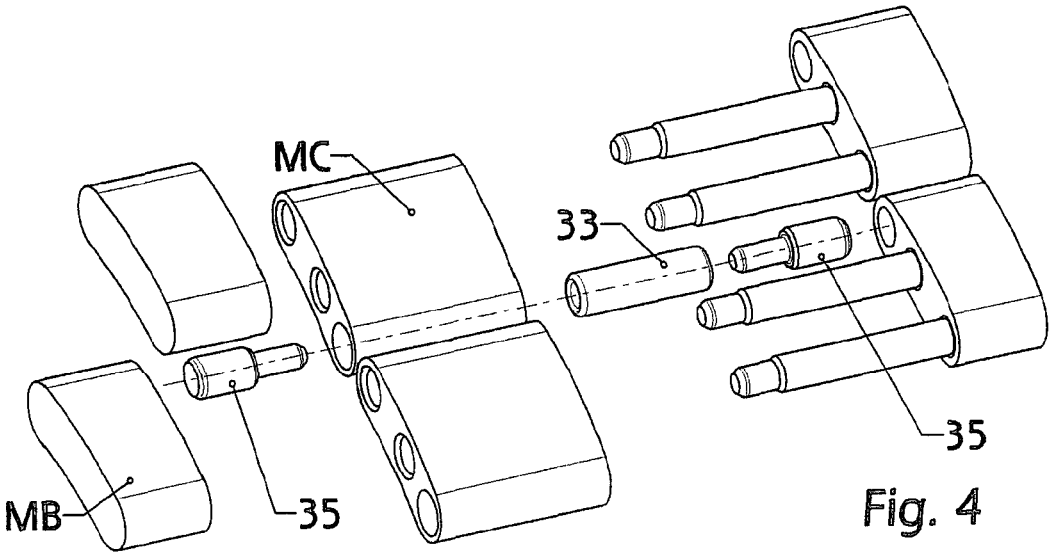
FIG. 4 is an exploded perspective view of a fourth embodiment.

The embodiment of FIG. 4 comprises a bearing tube 33 fixed in a central link MC. The hinge pin 35 is in this case divided into two parts. Each part of this hinge pin comprises a segment of greater diameter, driven into an edge link MB and a part of much smaller diameter, freely engaged in the bearing tube 33, such that once assembled, the distance between the segments of greater diameter is equal to the length of the tube increased by a functional clearance allowing the pivoting of the links. The bearing tube 33 is made of sintered ceramic, or a ceramic-metal composite, and the hinge pin is made of one of the above materials to reduce the wear with the ceramic tube. As in the embodiments of FIGS. 2 and 3, the lateral friction is produced between the ends of the bearing tube 33 and the bearing surfaces between the segments of different diameters of the hinge pin 35 in two parts.

Figure 5:
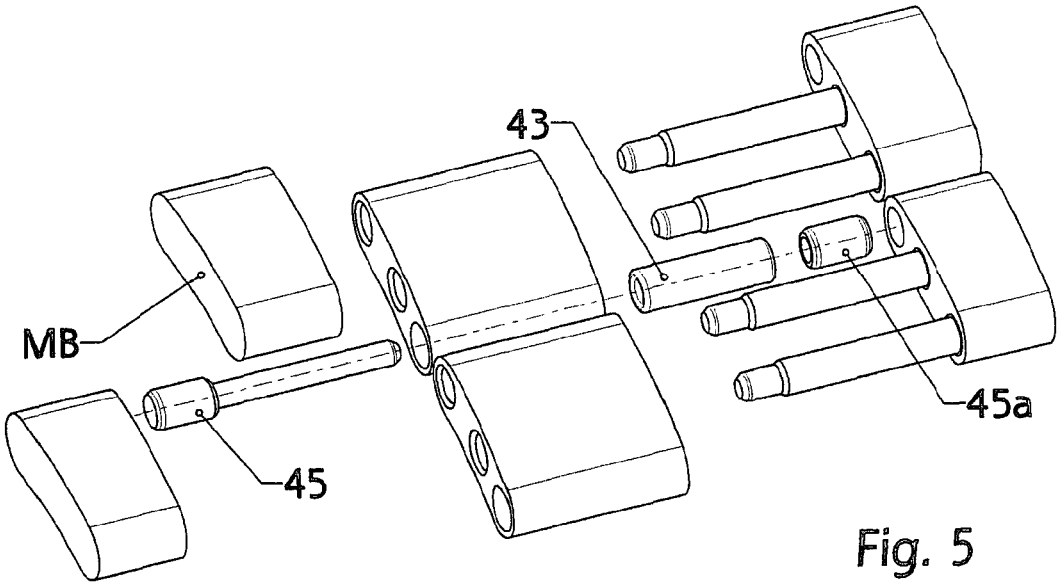
FIGS. 5 and 6 are exploded perspective views of two variants of FIG. 4.

As a variant, as illustrated by FIG. 5, the two pivot pin halves may be replaced by a hinge pin 45 comprising a segment of greater diameter driven into an edge link MB and a segment of smaller diameter freely engaged in the bearing tube 43 and a sleeve 45*a* driven into the edge link MB located opposite the edge link into which the segment of greater diameter of the hinge pin 45 is driven. By adjusting the depth of driving-in of the hinge pin 45 and of the sleeve 45*a*, it is possible that the lateral friction is produced exclusively between the ends of the bearing tube 43 and the bearing surface of the hinge pin 45 on the one hand and the end of the sleeve 45*a* on the other hand.

Figure 6:
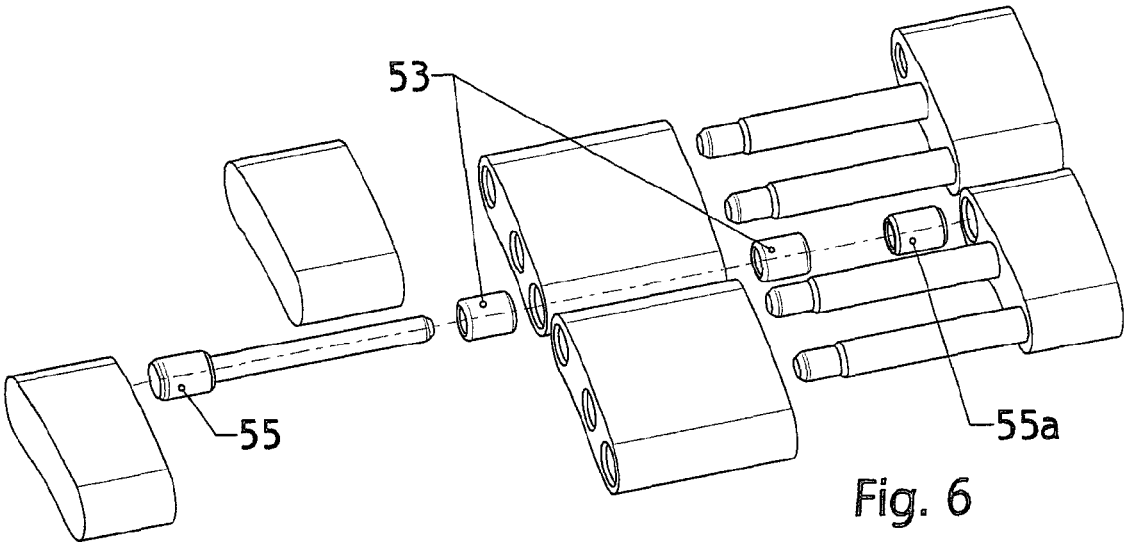

In the variant of FIG. 6, the bearing tube 53 is divided into two shorter half tubes to avoid driving-in over the entire width of the central link MC.

Figure 7:
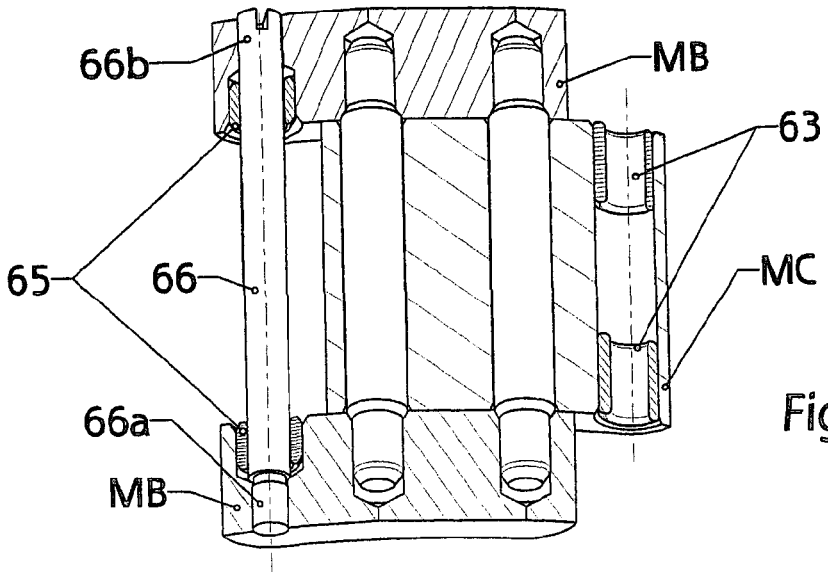
FIG. 7 is a sectional view along the hinge pins of the links of the strap.

FIG. 7 illustrates a device for adjusting the length of the strap. To this end, the hinge pin 66 has a threaded portion 66*a* at one end and a screw head 66*b* at the opposite end. To avoid lateral friction between the edge links MB and the central link MC, two small bearing tubes 65 are driven into the edge links MB. The lateral friction is produced between these bearing tubes 65 and the bearing tubes 63 driven into the central link MC.

Figure 8:
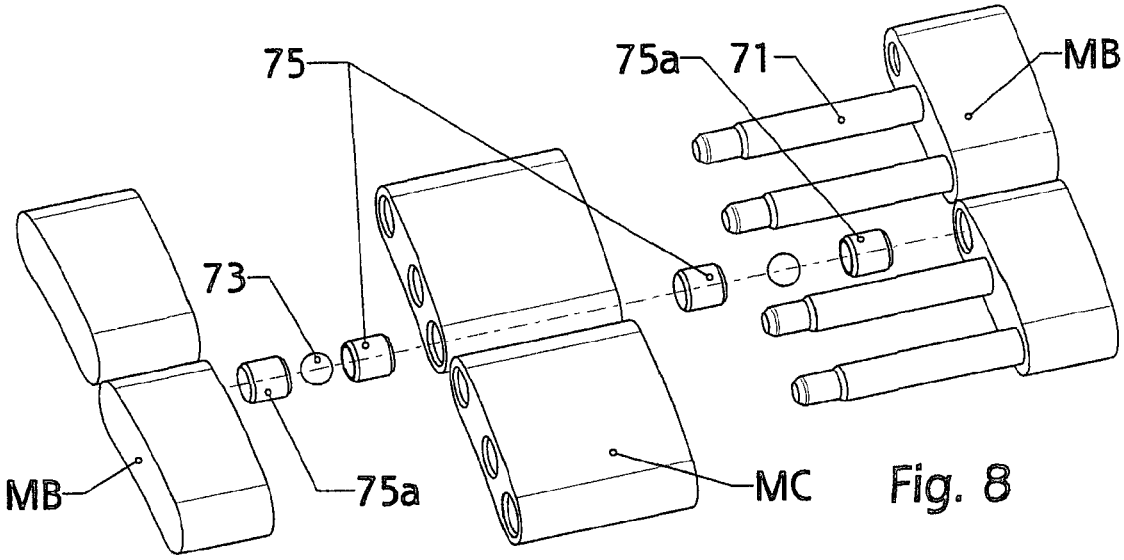
FIG. 8 is an exploded perspective view of a fifth embodiment.

In the embodiment of FIG. 8, the bearing tube(s) is(are) replaced by balls 73 which are sandwiched between two sleeves 75 driven into a central link MC and two sleeves 75*a* driven respectively into the two adjacent edge links MB. The edge links MB are assembled by driving in connecting elements 71 which hold the balls 73 in contact with the annular edges of the sleeves 75, 75*a*, which advantageously form truncated surfaces.

Figure 9:
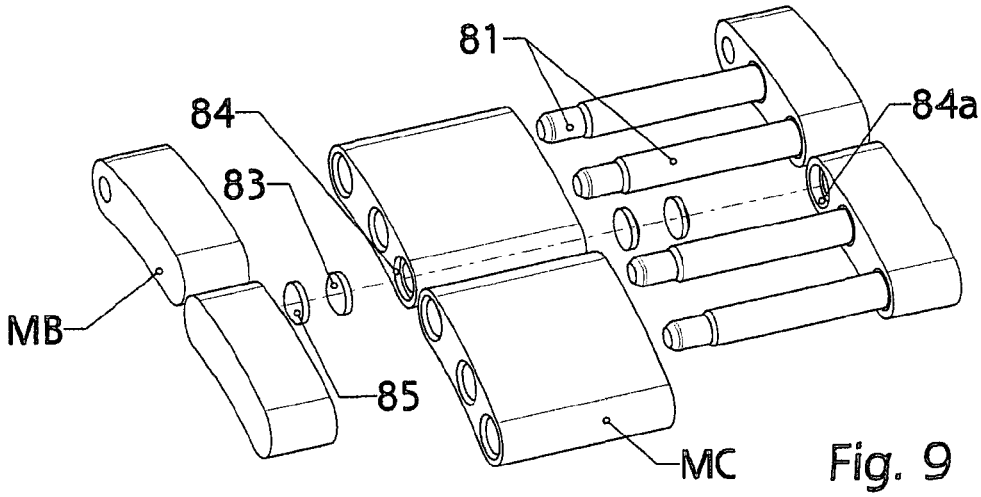
FIG. 9 is an exploded perspective view of a variant of FIG. 8.

In the variant of FIG. 9 are two lens-shaped friction members. One 83 is made of ceramic and is placed in a housing 84 formed in each lateral face of the central link MC of one of the fixed assemblies. Its convex contact face projects from the lateral face of the central link (MC). The further lens-shaped member 85 is selected in one of the above materials for its reduced wear when in frictional contact with the ceramic and is housed in a housing 84*a* made in the internal lateral face of each edge link MB, its convex face projecting from this lateral face to come into contact with the convex face of the ceramic member 83. The entire assembly is maintained by the connecting elements 81 driven into the two edge links. Depending on the material of which the links are made, the lenses 83, 85 are fixed in their housings 84, 84*a*, for example by bonding.

Figure 10:
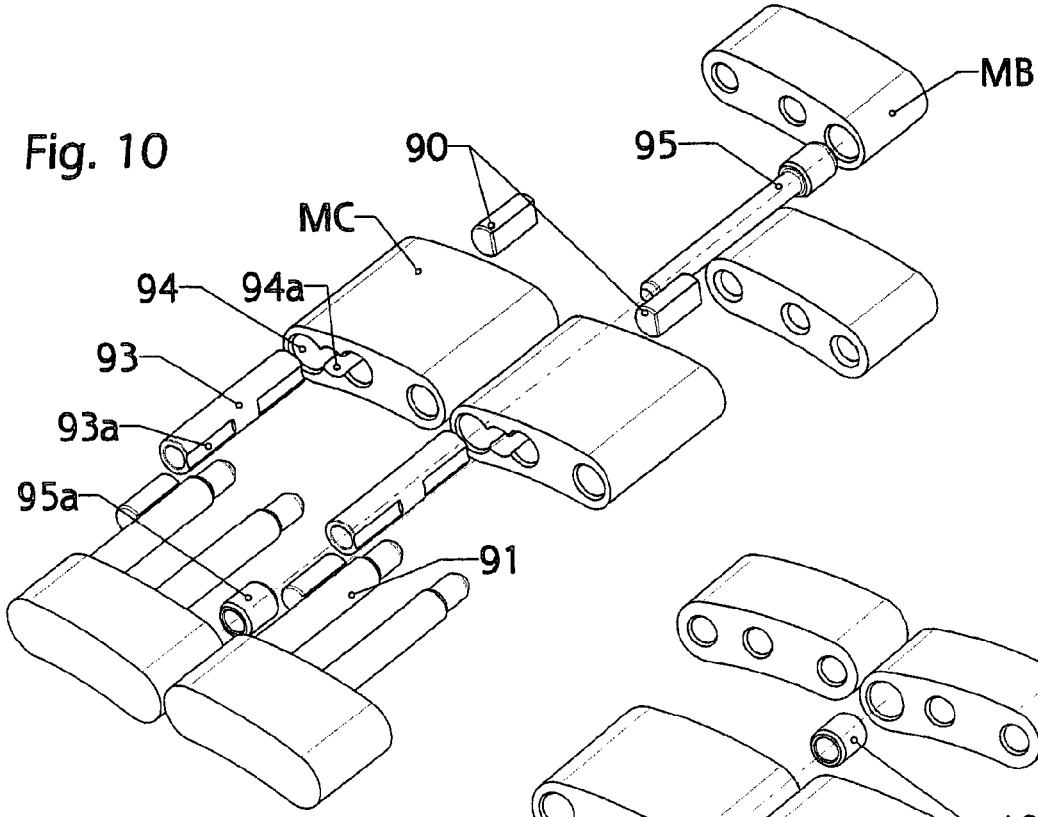
FIG. 10 is an exploded perspective view of a sixth embodiment.

In general, it is preferable that the bearing tube is fixed to the link and is not able to rotate or move in a linear manner therein. In the previous examples, driving-in or bonding has been discussed. The driving-in of a ceramic tube is not easy to implement. In addition, the embodiments of FIGS. 10 to 14 are alternative means of fixing. FIG. 10 relates to a bearing tube 93 provided with recessed surfaces 93*a* to cooperate with locking pins 90, preferably made of plastics, engaged in adjacent openings 94*a* and communicating with a transverse passage 94 receiving the bearing tube 93, adjusted and clamped between the tube and the pin 91.

Figure 11:
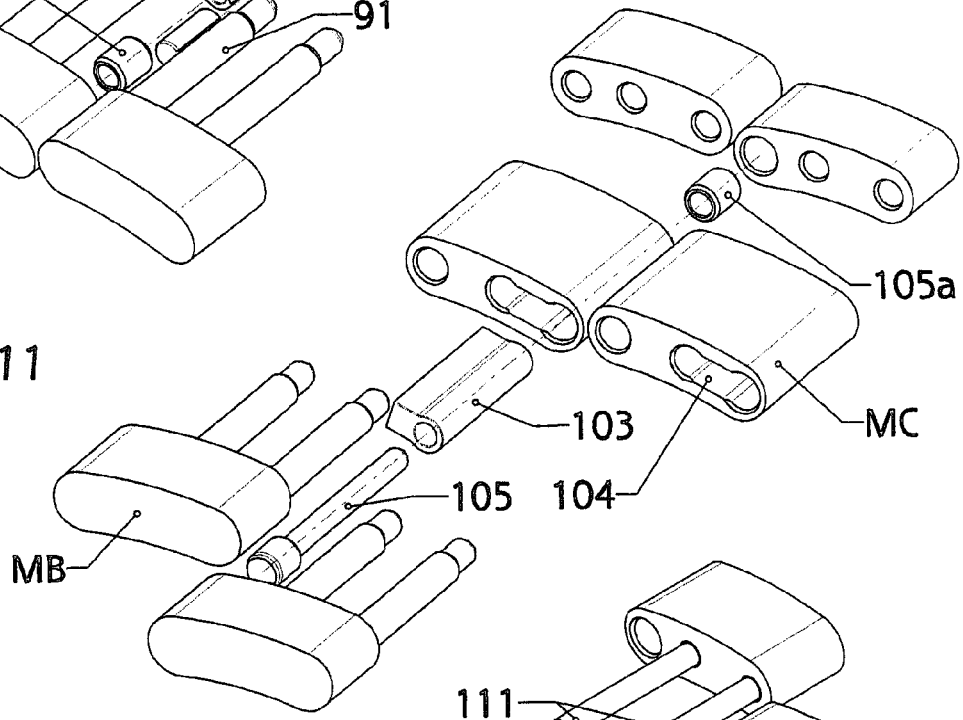
FIG. 11 is an exploded perspective view of a variant of FIG. 10.

A different manner of fixing the bearing tube 103 in the central link MC consists in producing a tube in the form of a sintered ceramic profile of which the non-circular section has a projection as illustrated by FIG. 11. The section of this profile 103 corresponds to a portion of the section of the passage 104 formed transversely to the central link MC. The projection of the section has to be sufficient to come into contact with the links MB and thus block the translation of the profiled tube. The hinge pin 105 is similar to the hinge pins of FIGS. 5, 6 and 10, with an end segment of greater diameter driven into an edge link MB located on one side of the central link MC, a sleeve 105*a* being driven into the edge link MB located on the other side of the central link MC. This sleeve 105*a* and the bearing surface between the segment of greater diameter and the segment of smaller diameter of the hinge pin 105 are used for lateral friction with the ends of the profiled bearing tube 103, of which the length is very slightly greater than the width of the central link MC.

Figure 12:
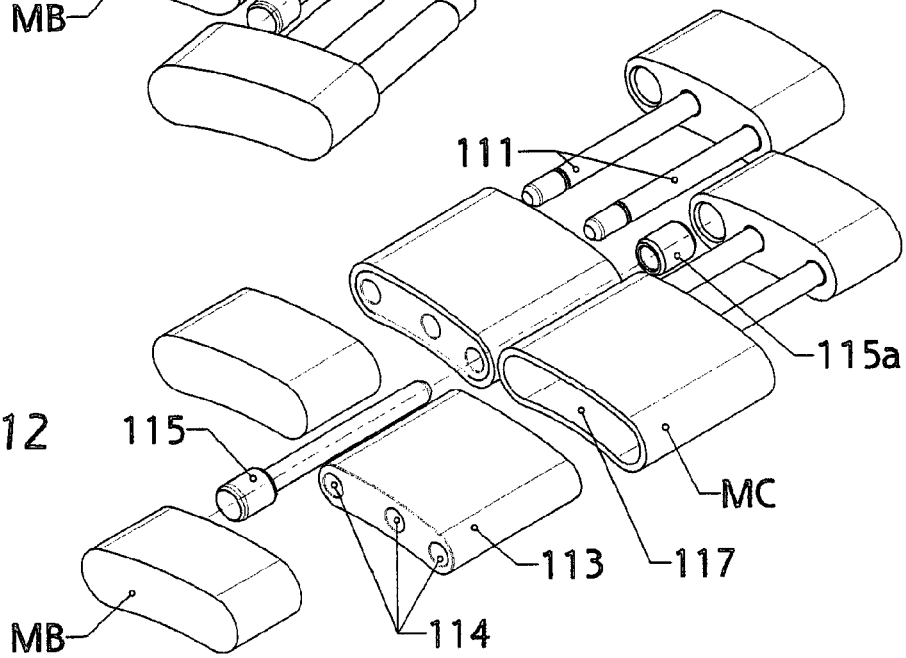
FIG. 12 is an exploded perspective view of a seventh embodiment.

In the case of FIG. 12, the central link MC is a hollow profile in the transverse direction, in the opening 117 of which is introduced an insert made of sintered ceramic or ceramic-metal composite 113 of which the section is exactly complementary, allowing for clearance, to that of the opening 117 of the hollow profile forming the central link MC. The insert 113 comprises three passages 114, two for the connecting elements 111 of which the ends are driven into the edge links MB of the two external rows of the strap and a passage 114 for the hinge pin 115, identical to the hinge pin of FIGS. 5, 6, 10, 11. As in all the embodiments above, the material of the hinge pin 115 and of the sleeve 115*a* is one of the abovementioned materials for friction against the insert made of sintered ceramic or sintered ceramic-metal. Advantageously, this hinge pin 115 and the sleeve 115*a* are of the same metal or alloy as the strap links when said strap is made of a gold alloy, platinum alloy or platinoid alloy. Preferably, the strap is made of stainless steel without nickel, if the links are made of steel, even if certain links are made of steel and others of a gold alloy. It could also be made of a metal coated with amorphous carbon.

Figure 13:
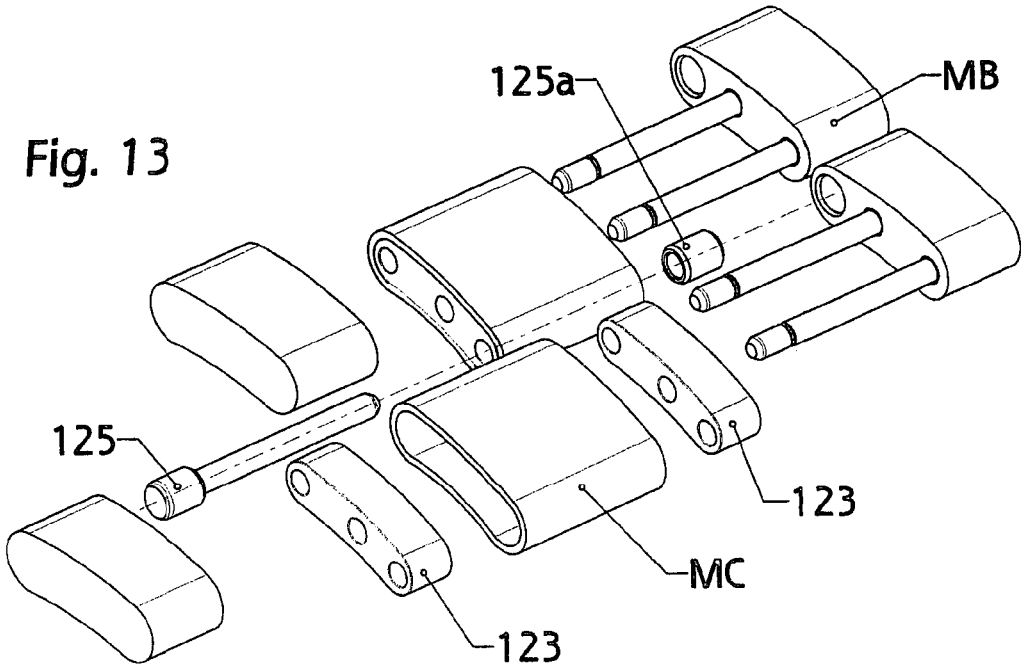
FIG. 13 is an exploded perspective view of a variant of FIG. 12.

In the variant of FIG. 13, the inserts 123 in two parts are driven-in at the two ends of the opening of the hollow profile forming the central link MC, so as to promote the contact with the bearing surfaces of the hinge pins 125 and 125*a* and the inserts. The remainder of this variant is identical to the embodiment of FIG. 12.

Figure 14:
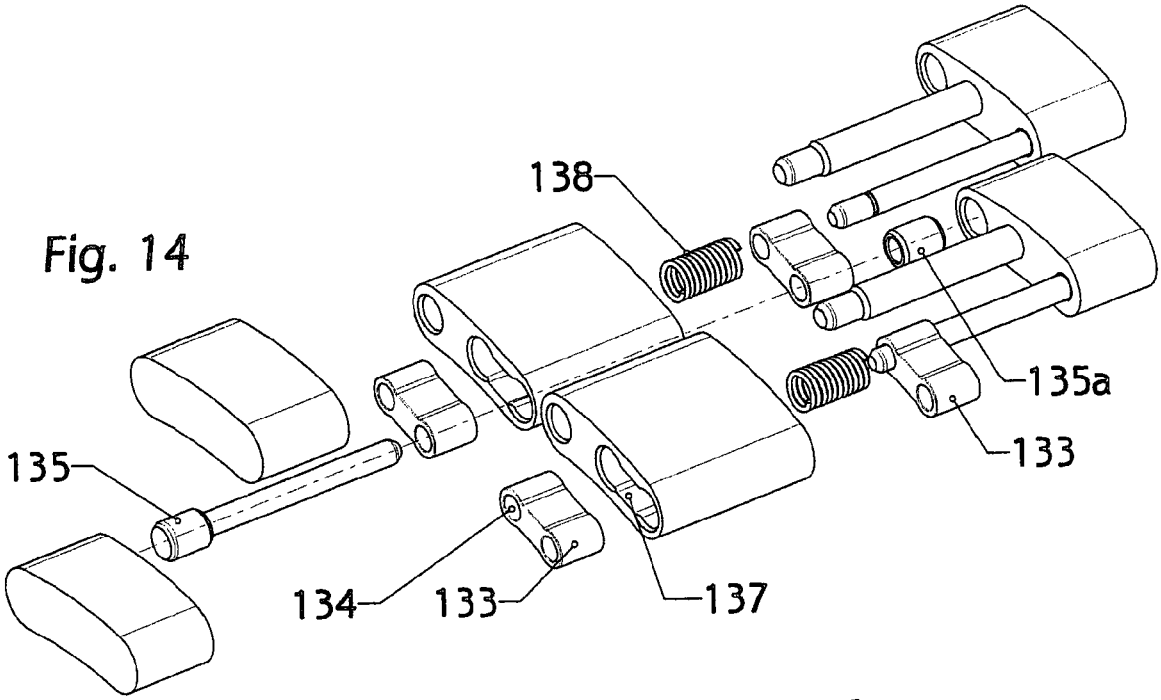
FIG. 14 is an exploded perspective view of an eighth embodiment.

The variant of FIG. 14 differs from the above essentially by the fact that a spring 138 operating in compression is interposed between the two inserts 133 made of sintered ceramic or sintered ceramic-metal composite, thus applying an advantageous contact between an insert 133 and the sleeve 135*a* driven into an edge link MB and which is coaxial with the hinge pin 135, in addition to between the other insert 133 and the bearing surface between the segment of greater diameter of the hinge pin 135 and its segment of smaller diameter.

Figure 15:
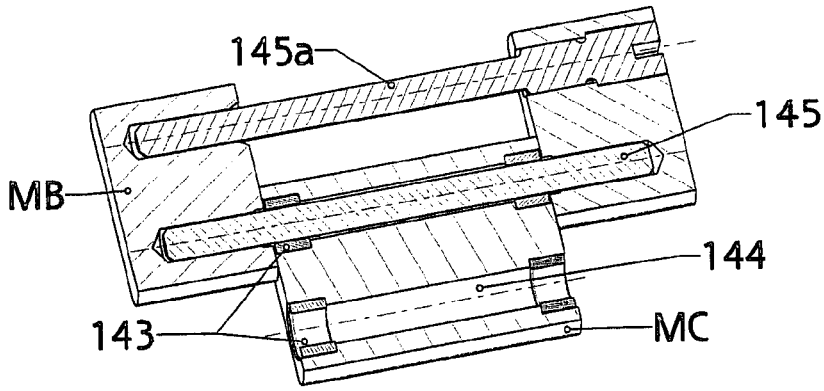
FIG. 15 is a sectional view along the hinge pins of the links of the strap, of a ninth embodiment.

The embodiment illustrated by FIG. 15 relates more specifically to a strap of which the links are made of metal or a precious metal alloy. In this case, the hinge pins 145 are advantageously in the same metal or alloy as that of the links and are preferably soldered into the edge links MB. The bearings 143 are small sintered ceramic tubes, freely mounted in the transverse passages 144 of the central links MC, given that the degree of friction between the ceramic and a gold alloy or platinoid alloy is advantageous from the point of view of reducing wear.

In FIG. 15 the case has been shown where a pivot pin consists of a screw 145*a*, thus making it possible to add or remove links to adjust the length of the strap.

Figure 16A:
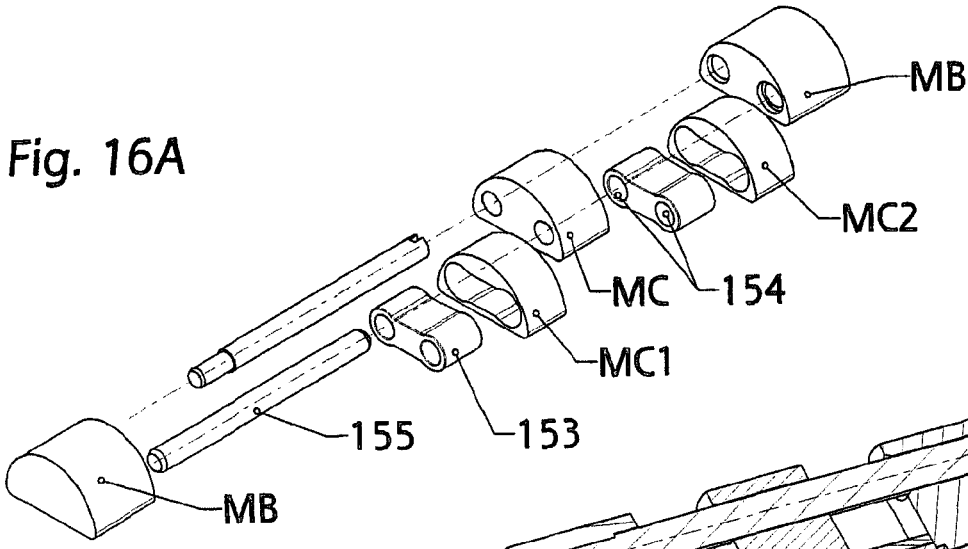
FIGS. 16A, 16B are respectively an exploded perspective view and a sectional view along the hinge pins of the links of the strap, of a tenth embodiment.
Figure 16B:
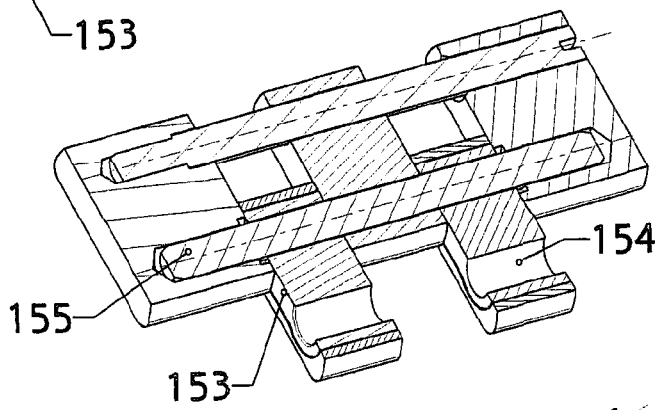

FIGS. 16A, 16B illustrate a variant of a strap, of which the links and the hinge pins are made of a gold alloy or platinoid alloy. This strap has five rows with links offset alternately from one row to another. This strap thus comprises two rows of edge links MB and three rows of central links MC, $MC_1$, $MC_2$. Two inserts made of ceramic or a ceramic-metal composite 153 are housed in the central links $MC_1$, $MC_2$ and have transverse passages 154 for the hinge pins 155.

Figure 17A:
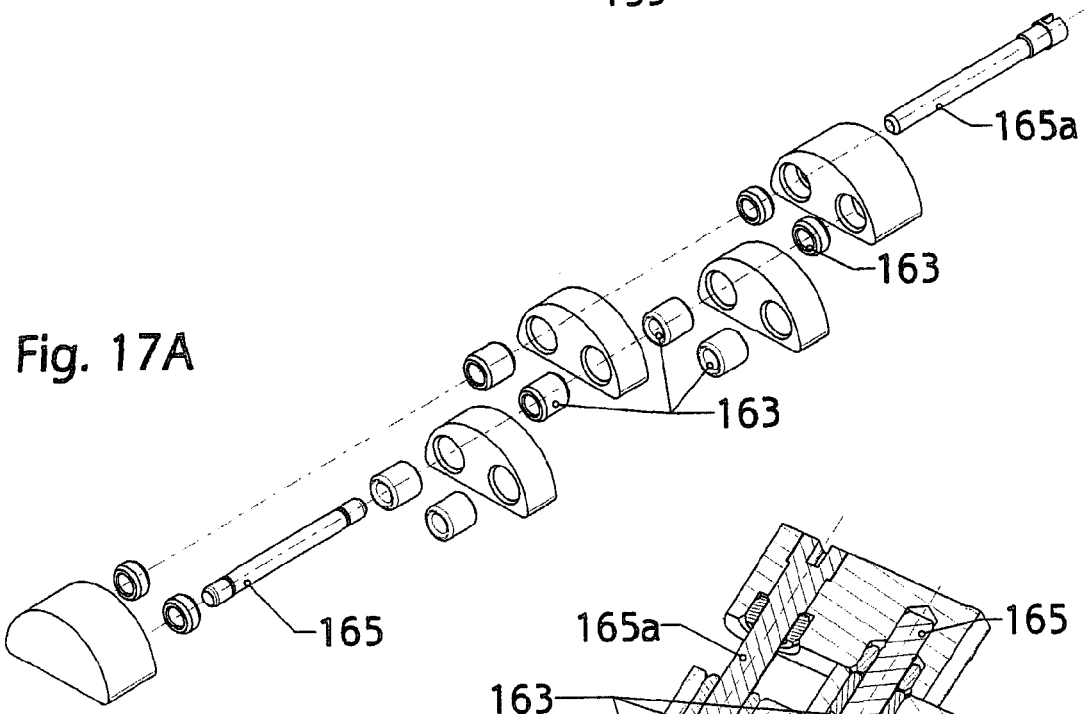
FIGS. 17A, 17B are respectively an exploded perspective view and a sectional view along the hinge pins of the links of the strap, of an eleventh embodiment.
Figure 17B:
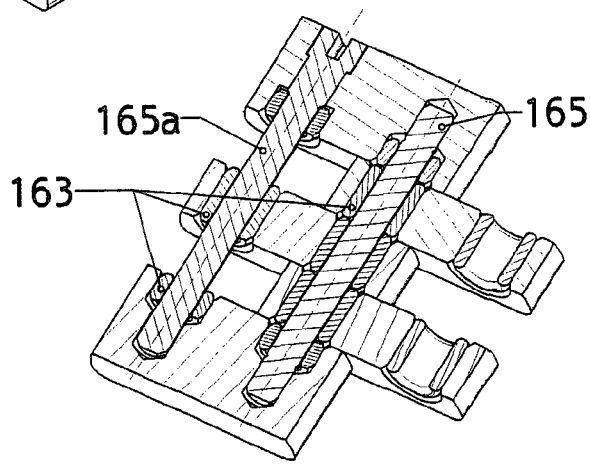

For the same type of strap with five rows of alternate links, but made of steel, there are as many tubes 163 as the product of the number of links times the number of hinge pins 165, namely ten tubes in the strap portion illustrated by FIGS. 17A, 17B. The ends of the hinge pins 165 are fixed in the edge links MB. In this case, one of the pins 165*a* has been shown in the form of a screw to allow the adjustment of the length by removing or adding links.

The dimensions of the bearings 163 transversely to the strap are selected so that the lateral friction between the links is produced exclusively between the end faces of the bearings 163, which are fixed in the links MB, MC, $MC_1$, $MC_2$. Thus all the friction is produced between these bearings 163 or between the bearings and the hinge pins 165 which are preferably made of a cobalt alloy. These pins could also be made of stainless steel without nickel or even made of a different metal coated with amorphous carbon or ceramic.

The materials capable of reducing the frictional wear against a friction surface of which the hardness is >800 HV have been tested using a tribometer comprising a disk made of one of the materials to be tested, against which an arm applies a ball made of the other of the materials to be tested, at a specific force. The difference between the diameter of the impression on the ball and the depth of the groove on the disk is measured and the total worn volume of the two materials is calculated.

Figure 18:
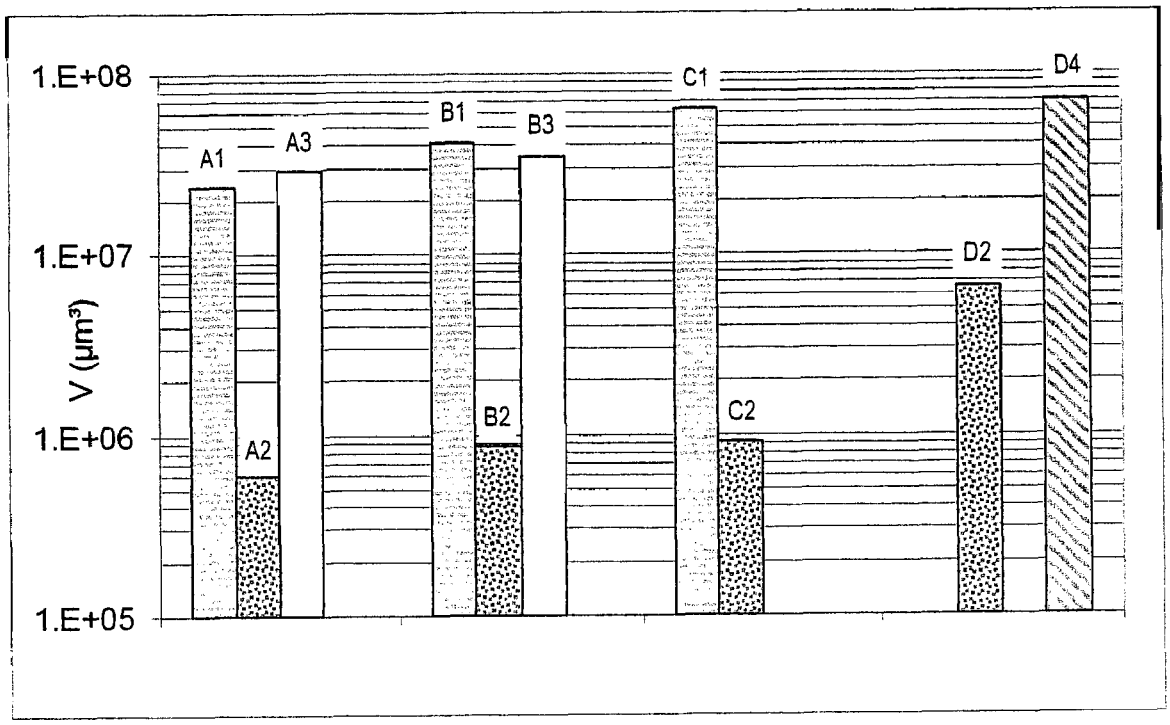
FIG. 18 is a comparative diagram of wear of different pairs of materials.

A series of comparative tests has been carried out. The results of these tests are shown in the diagram of FIG. 18. On the abscissa, four comparative tests A, B, C, D have been shown and on the ordinate the worn volume in $\mu m^3$ has been shown. The tests are carried out by attempting to reproduce the actual conditions in which a watch strap is used. To this end, the tests have been carried out with a particular additive and in a controlled atmosphere. The additive consists of an abrasive (silica powder) in an organic oil matrix.

$A_1$ corresponds to the frictional wear between a disk made of austenitic stainless steel with nickel, standard in the field of watch straps, such as 316L and a ball made of a cobalt alloy.

$A_2$ corresponds to the frictional wear between the same ball made of a cobalt alloy in friction against a sintered zirconia disk.

$A_3$ corresponds to the frictional wear between an 18 carat gold disk and a disk made of a cobalt alloy.

$B_1$ corresponds to the frictional wear of a ball made of 18 carat yellow gold, against a disk made of austenitic stainless steel with nickel.

$B_2$ corresponds to the frictional wear of a ball made of 18 carat yellow gold, against a disk made of sintered zirconia.

$B_3$ corresponds to the frictional wear of a ball made of 18 carat yellow gold against a disk made of 18 carat yellow gold.

$C_1$ corresponds to the frictional wear of a titanium ball against a disk made of austenitic stainless steel with nickel.

$C_2$ corresponds to the frictional wear of a titanium ball against a disk made of sintered zirconia.

$D_2$ corresponds to the frictional wear of a platinum ball against a disk made of sintered zirconia.

$D_4$ corresponds to the frictional wear of a platinum ball against a platinum disk.

The invention claimed is:

1. Strap with articulated links for a watch, comprising:

at least three adjacent longitudinal rows of links offset longitudinally from one adjacent row to another, said links comprising transverse passages, connecting rods received in said transverse passages so that said rows of links are connected and positioned by said connecting rods.

said strap comprising joints, wherein each joint comprises:

(i) friction surfaces with axial guidance and (ii) friction surfaces with lateral guidance, wherein all the friction surfaces of each joint consist of a pair of materials formed from a first material having a hardness of more than 800 HV and a second material selected from the following materials: ceramic, ceramic-metal composite, amorphous carbon, stainless steel without nickel, cobalt alloy, gold, gold alloy, platinum, platinum alloy, platinoid, platinoid alloys, titanium, titanium alloy, each of the pairs of materials making it possible to reduce substantially the wear between said friction surfaces relative to any other pair of materials.

2. Strap according to claim 1, in which one of said friction surfaces is that of at least one attached bearing element made of sintered ceramic, or a sintered ceramic-metal composite.

3. Strap according to claim 1 in which one of said friction surfaces comprises a substrate coated with one of the following materials: ceramic, ceramic-metal, amorphous carbon.

4. Strap according to claim 1, in which the links are metal links.

5. Strap according to claim 1, wherein said friction surfaces with axial guidance of said joints are formed on (i) at least one bearing, and (ii) a hinge pin, respectively, said at least one bearing being attached to a central link disposed in a central row among said rows of links, said hinge pin having ends fixed in edge links disposed in rows other than said central row among said rows of links, and said hinge pin passing through said at least one bearing, said hinge pin being in said second material, and said at least one bearing being in said first material.

6. Strap according to claim 1, comprising:

a first assembly and a second assembly, each formed by two edge links aligned transversely and a central link offset longitudinally, the first assembly and the second assembly being adjacent and articulated each other by a hinge pin, a friction surface of the hinge pin forming one of said friction surfaces of the joint, wherein ends of the hinge pin are fixed to the two edge links of the first assembly and a central part of the hinge pin has a segment of greater diameter creating two bearing surfaces, said hinge pin being engaged in two bearing tubes, forming at least one other friction surface, said bearing tubes being fixed in a transverse passage passing through a part offset longitudinally of the link (MC) of the central row of the second adjacent assembly, on both sides of the central segment of greater diameter of said pin.

7. Strap according to claim 1, comprising:

a first fixed assembly and a second fixed assembly, each formed by two edge links aligned transversely and a central link offset longitudinally, the first assembly and the second assembly being adjacent and articulated to each other by a hinge pin, a friction surface of the hinge pin forming one of said friction surfaces of the joint, wherein a central part of the hinge pin comprises a segment of greater diameter fixed to the central link of the first fixed assembly and creating two bearing surfaces, said hinge pin being engaged in two bearing tubes, forming at least one further friction surface, said bearing tubes being fixed in a transverse passage made respectively in the two edge links of the second adjacent fixed assembly, on both sides of the central segment of greater diameter of said hinge pin, bearing surfaces of said hinge pin forming abutments for said bearing tubes to provide lateral friction between the fixed assemblies.

8. Strap according to claim 1, comprising:

A first fixed assembly and a second fixed assembly, each formed by two edge links aligned transversely and a central link offset longitudinally, the first assembly and the second assembly being articulated to each other by a hinge pin, a friction surface of the hinge pin forming one of said friction surfaces of the joint, wherein the hinge pin has two parts, each of said two parts comprising:

a segment of greater diameter, fixed in an edge link of the first fixed assembly, and a segment of smaller diameter, freely engaged in a bearing tube forming at least one further friction surface of said joint and transversely passing through the central link of the second fixed assembly, wherein lateral friction is created between ends of the bearing tube and bearing surfaces formed between the segments of different diameters of the hinge pin in two parts.

9. Strap according to claim 1, comprising:

a first fixed assembly and a second fixed assembly, each formed by two edge links aligned transversely and a central link offset longitudinally, the first assembly and the second assembly being adjacent and articulated with each other by a hinge pin, a friction surface of the hinge pin forming one of said friction surfaces of the joint, wherein the hinge pin comprises:

a segment of greater diameter fixed in an edge link of the first fixed assembly; and a segment of smaller diameter, freely engaged in a bearing tube forming at least one further friction surface of said joint and transversely passing through the central link of the second fixed assembly, a sleeve forming at least one further friction surface of said joint being fixed in the other edge link of the first fixed assembly, wherein lateral friction is produced between (i) ends of the bearing tube and a bearing surface of the hinge pin, and (ii) an end of the sleeve.

10. Strap according to claim 1, comprising:

a first fixed assembly and a second fixed assembly, each formed by two edge links (MB) aligned transversely and a central link offset longitudinally form a first fixed assembly, the first assembly and the second assembly being adjacent and articulated with each other, the friction surfaces of each joint comprising (i) balls made of one of the two materials, arranged between each lateral end of the projecting part of the central link of the first assembly and the adjacent lateral faces of the edge links of the second fixed assembly, each ball being engaged between two respective annular friction surfaces of two articulated tubes of the other of said materials, respectively fixed to two transverse passages opening into the respective lateral faces of the edge link of the second fixed assembly and of the projecting part of the central link of the first assembly.

11. Strap according to claim 1, comprising:

a first fixed assembly and a second fixed assembly, each formed by two edge links aligned transversely and a central link offset longitudinally, the first assembly and the second assembly being adjacent and articulated with each other, each joint comprising two pairs of projecting contact surfaces, one of said pairs of contact surfaces projecting from an internal lateral face of a part of each edge link of the first fixed assembly, adjacent to a respective one of two lateral faces of the central link of the second fixed assembly, the other of said pairs of contact surfaces projecting from each of lateral faces of the central link of the second fixed assembly.

12. Strap according to claim 1, in which one of said friction surfaces is a bearing surface formed by a tubular element housed in a transverse passage of the central link or edge link, wherein a cylindrical face of said tubular element is interrupted by a recessed surface cooperating with a pin housed in an adjacent opening communicating with the transverse passage receiving the tubular element.

13. Strap according to claim 1, in which one of said friction surfaces is a bearing surface formed in a profiled element of non-circular section, housed in a passage, wherein one part of a section of said passage at least corresponds to a section of said profiled element.

14. Strap according to claim 1, in which the central link is a hollow profile in the transverse direction, the hollow profile having an opening, wherein an insert having a section complementary to a section of the opening of the hollow profile forming the central link is introduced in the opening of the hollow profile, and wherein the central link comprises three transverse passages, two of said transverse passages being for connecting elements, said connecting elements having ends driven into the edge links of the two external rows of the first fixed assembly, and a third of said transverse passages forming one of said friction surfaces of said joint for the hinge pin, said hinge pin having the other friction surface of said joint.

15. Strap according to claim 1, in which the central link comprises a passage of non-circular section, said passage freely receiving two inserts each having a section is complementary to a section of said passage, said inserts having transverse passages forming one of said friction surfaces a hinge pin received in said transverse passages of said inserts forming another friction surface, and a resilient element operating in compression being interposed between said inserts.

16. Strap according to claim 1, comprising:

A first assembly and a second assembly, each comprising two edge links aligned transversely and a central link offset longitudinally, the first assembly and the second assembly being adjacent and articulated with each other by a hinge pin, wherein the links and the hinge pin are in said second material, ends of the hinge pin being fixed in the edge links of the first assembly and passing through at least one bearing in said first material freely engaged in a transverse passage of the central link of the second assembly.

17. Strap according to claim 1, comprising five rows of links offset longitudinally, alternately from one row to another, wherein the links and the hinge pins are in said second material, ends of the hinge pins being fixed in the edge links aligned transversely and passing through two bearings in said first material engaged in two transverse passages of two central links offset longitudinally relative to the three other links.

18. Strap according to claim 1, in which said first material is a zirconia-based material.

* * * * *